US008207467B2

(12) United States Patent
De Maranon Ibabe et al.

(10) Patent No.: US 8,207,467 B2
(45) Date of Patent: Jun. 26, 2012

(54) AUTOMATIC METHOD AND SYSTEM FOR THE DETERMINATION AND CLASSIFICATION OF FOODS

(75) Inventors: Inigo Martinez De Maranon Ibabe, Sukarrieta (ES); Raquel Rodriguez Fernandez, Sukarrieta (ES); Aitor Lasa Moran, Donostia-san Sebastian (ES)

(73) Assignees: Fundacion Azti-Azti Fundazioa, Sukarrieta (ES); Fundacion Fatornik, Donostia-San Sebastian (ES)

( * ) Notice: Subject to any disclaimer, the term of this patent is extended or adjusted under 35 U.S.C. 154(b) by 0 days.

(21) Appl. No.: 12/812,955

(22) PCT Filed: Jan. 17, 2008

(86) PCT No.: PCT/ES2008/070007

§ 371 (c)(1), (2), (4) Date: Oct. 18, 2010

(87) PCT Pub. No.: WO2009/090279

PCT Pub. Date: Jul. 23, 2009

(65) Prior Publication Data

US 2011/0024336 A1 Feb. 3, 2011

(51) Int. Cl.
*B07C 5/00* (2006.01)

(52) U.S. Cl. ..... 209/576; 209/3.2; 209/905

(58) Field of Classification Search ..... 209/3.2, 209/576–581, 903, 905; 382/110
See application file for complete search history.

(56) References Cited

U.S. PATENT DOCUMENTS

| | | | | | |
|---|---|---|---|---|---|
| 3,152,587 | A | * | 10/1964 | Ullrich et al. | 600/344 |
| 3,550,192 | A | * | 12/1970 | Ericksson | 452/179 |
| 4,051,952 | A | | 10/1977 | Hauptmann et al. | |
| 4,244,475 | A | * | 1/1981 | Green | 209/588 |
| 4,601,083 | A | * | 7/1986 | Shoji et al. | 452/64 |
| 4,869,813 | A | | 9/1989 | Bailey et al. | |
| 4,884,696 | A | | 12/1989 | Peleg | |
| 4,963,035 | A | * | 10/1990 | McCarthy et al. | 382/110 |
| 4,976,582 | A | | 12/1990 | Clavel | |
| 5,013,906 | A | * | 5/1991 | Miyakawa et al. | 250/223 R |
| 5,335,791 | A | | 8/1994 | Eason | |
| 6,396,938 | B1 | | 5/2002 | Tao et al. | |
| 6,649,412 | B1 | * | 11/2003 | Borggaard et al. | 436/20 |
| 7,044,846 | B2 | | 5/2006 | Eilertsen | |
| 7,258,237 | B2 | * | 8/2007 | Nielsen | 209/645 |
| 7,460,982 | B2 | * | 12/2008 | Wargon | 702/156 |
| 7,967,149 | B2 | * | 6/2011 | Helgi | 209/592 |

FOREIGN PATENT DOCUMENTS

| | | | |
|---|---|---|---|
| EP | 0250470 | | 7/1991 |
| JP | 2000116314 A | * | 4/2000 |
| WO | WO8703528 | | 6/1987 |
| WO | WO0122043 | | 3/2001 |
| WO | WO03045591 | | 6/2003 |
| WO | WO2007083327 | | 7/2007 |
| WO | WO2009063101 | | 5/2009 |

* cited by examiner

*Primary Examiner* — Joseph C Rodriguez
(74) *Attorney, Agent, or Firm* — Mark M Friedman

(57) ABSTRACT

Method and automatic system for the determination and the classification of foods based on a high-speed manipulation robot aided by a localization system which is capable of detecting the food which comes along a transport system in a random fashion without contact between one and the other, and to classify it; the robot incorporates a manipulation grip wherein a sensor which permits the determination and classification of the food is housed.

8 Claims, 2 Drawing Sheets

AUTOMATIC METHOD AND SYSTEM FOR THE DETERMINATION AND CLASSIFICATION OF FOODS

This Application is a national Phase Application of PCT/ES2008/070007, filed Jan. 17, 2008.

DESCRIPTION

1. Object of the Invention

The present invention relates to an automatic system and method for the determination and classification of foods.

The invention is based on a high-speed manipulation robot assisted by a localization system, which is capable of detecting foods which come along a conveyor belt in a random fashion and without contact with one another, and classifying them according to own characteristics. The robot incorporates a robotized manipulation grip wherein at least one sensor which permits the classification of food is housed.

2. Background of the Invention

There are automatic methods for the classification of foods such as U.S. Pat. No. 4,884,696. This document discloses an automatic method of classifying objects of different shapes.

In this invention, different sensors are found throughout the path that the object to classify will make. A wheel with grips rotates the products so that all it sides can be seen.

It is known in the state of the art a weighing and portioning technique as the one disclosed in WO 0122043 wherein said technique is based on a so called grader technique, where a number of items which are to be portioned out, namely natural foodstuff items with varying weight, are subjected to an weighing-in and are thereafter selectively fed together in a computer-controlled manner to receiving stations for the building-up of weight-determined portion in these stations.

Another document related with the object of the present invention, is WO2007/083327, where is disclosed an apparatus for grading articles based on at least one characteristics of the articles.

The present invention discloses an automatic system and method for the classification of different foods, wherein the foods enter through a transport system and their presence is detected by a localization system, without having to move or rotate the food, and once the food and its position on the conveyor belt have been recognized by said system, a robotized grip which has at least one sensor, classifies the food.

BRIEF DESCRIPTION OF THE DRAWINGS

Advantages of the present invention will be readily appreciated as the same become better understood by reference to the following details description when considered in connection with the accompanying drawings wherein.

DESCRIPTION OF THE INVENTION

The present invention aims to resolve the problem of determining and classifying, in an automatic fashion, foods.

The solution is to develop an automatic system which is capable of determining characteristics typical of each food and classifying them in accordance with them.

In a first aspect of the invention, it relates to an automatic method for the determination and classification of foods, which comprises, at least, the following stages:

feeding of the food to be classified into a transport system along which the food moves, determination using a localization system of the position, orientation, geometry and size of the food, positioning of a robotized grip on the food, thanks to the information obtained by the localization system, data collection using a sensor present in the robotized grip and classification of the food in accordance with the data obtained by the sensor, separation of the food classified.

In a second aspect of the invention, it relates to an automatic system for the determination and classification of foods which comprises at least:

a transport system along which the food moves, a localization system of the position, orientation, geometry and size of the food, a robotized grip which is positioned on the food, thanks to the information obtained by the localization system, at least one sensor present in the robotized grip for the classification of the food.

When the present invention speaks of transport system this may be both manual and automatic, such as for example a conveyor belt.

When the present specification refers to a localization system, this may be an artificial vision system which functions using microwaves, ultrasounds, infrared, ultraviolet, X-rays, etc.

The manipulation grip of the foods present en the robot, may act via vacuum, pneumatic, hydraulic or electromechanical actuators or passive methods, among others, so that on the one hand it adapts to the geometry and physical characteristics of the product for its correct manipulation and, on the other hand, to the integrated sensor system, integrated sensor.

The sensor collects the data from the outer part of the food or by introducing itself therein.

PREFERRED EMBODIMENT OF THE INVENTION

Figure 1:
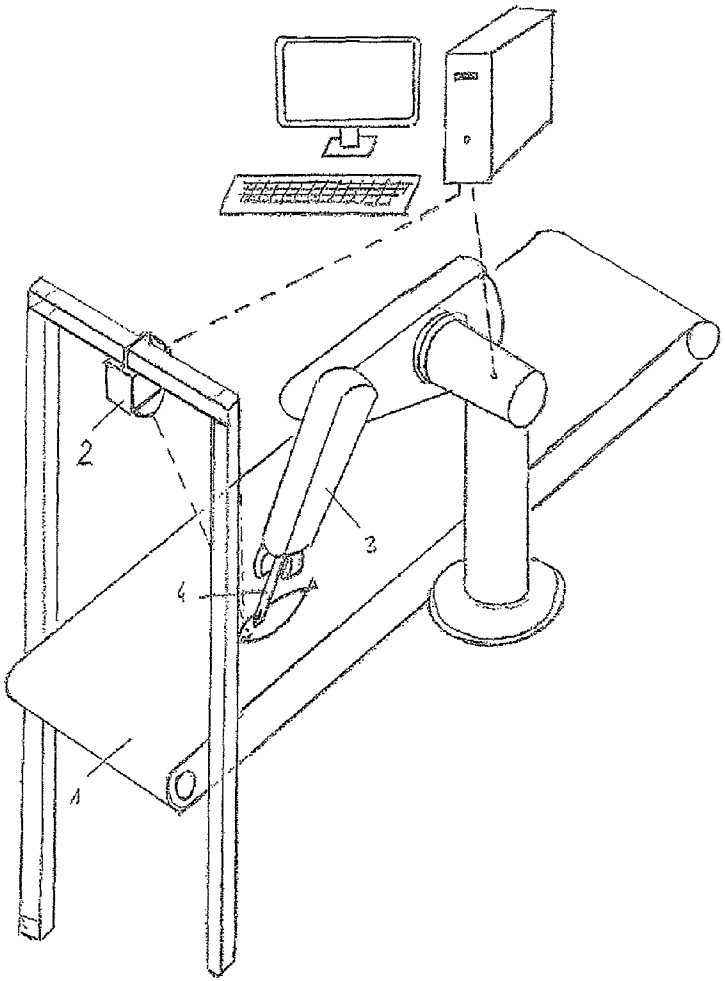
FIG. 1 illustrates an automatic system for the classification and separation of foods, according to embodiments of the present invention.

FIG. 1 illustrates an automatic system for the classification and separation of foods, according to embodiments of the present invention;

In an example of embodiment of the invention, the food which is going to be classified is fish, and in particular mackerel.

The mackerel is introduced via a conveyor belt of a transport system 1.

This fish is detected by a vision system of a localization system 2 which permits that the robotized grip 3 is subsequently placed on the mackerel, to collect the data necessary for its classification.

In this example of embodiment, the aim is to classify mackerels into male and female.

The measurement is made in this example of embodiment by the insertion of a sensor 4 in the food, in particular on or in the fish's gonads. The sensor 4 is present in the robot grip 3 and thanks to the information recovered by the vision system, the sensor will be inserted in a suitable place for the correct determination of the gender of the fish.

The vision system detects the fish as they move along the conveyor belt and correctly identifies their position and orientation. After detection, the vision system, which has previously been calibrated with respect to the robot and the conveyor belt, performs the transformation of the reference system to send the coordinates of the point where the sensor should be inserted to the robot with the grip.

The vision system is composed of three main parts: the illumination system, optics and the software that analyses the images.

The illumination system pursues different objectives: maintaining a constant illumination in the working area to eliminate variations which hinder or even prevent the work of the analysis software through a computer 5, eliminating the shadows projected by the objects, removing glare and reflections on objects and the belt, maximizing the contrast between the objects to analyse and the background, the conveyor belt.

To achieve that the illumination intensity is constant, an enclosure is constructed which isolates the working area from external illumination.

The vision system in this example of embodiment has two sources of high-intensity linear illumination. The sources function at a sufficiently high frequency to avoid flashing and fluctuations in intensity.

The sources are placed on both sides of the conveyor belt, and at a suitable height thereon. They are place opposite one another, so that the light indirectly hits the conveyor belt, in this way avoiding shadows and glare.

To select the suitable optics of the vision system, it is necessary to basically bear in mind the size of the camera sensor, the distance to the working plane and the size of the objects that should be detected.

For the detection system of the vision system initially, a statistical modelling of the background is made, i.e. the conveyor belt without any fish.

In this model each pixel of the image is stored as the sum of several Gaussian functions.

The number of Gaussians whereby the model is approximated depends on how flexible and adaptable it is needed to be: between three and five seems a suitable number in the tests.

This model is updated during the execution of the algorithm, so that the model is flexible to changes, both progressive and sudden, needing an adaptation time in both cases. To adapt the model and adjust the data obtained to the Gaussians, the Expectation Maximization (EM) algorithm is used. The pixel modelling enables differentiated areas both in colour/material and in illumination in the working area and the adaptation permits flexibility as regards the constancy of the illumination, provided that no saturation occurs in the sensor and the dynamic range is sufficient, and with regard to the colour of the belt, which may vary with time due to wear or dirt.

Using the previous statistical model the segmentation is made of the objects placed in the working space. A fixed limit is defined in accordance with the typical deviation of each Gaussian, and it is decided that a specific pixel belongs to an object if its value in the scale of greys is not within the bell defined by any of the Gaussians.

Next, an iterative growth algorithm is used of regions in two runs to identify the blobs or connected regions which are then going to be analysed. At this point, a simple filtering will also be performed in accordance with the area, the length and the length/width ratio to discard the most evident regions. Using the moments of inertia of first and second order, the mass centre of the object and its major and minor semi-axes are calculated, which permits identifying the orientation of the fish.

To correctly define the piercing area, two different measurements are taken. Initially a longitudinal division is made of the object and the intensity measurement calculated in both halves is compared using the mask obtained in the segmentation. In this way the position of the loin is distinguished with regard to the stomach. Finally, two transversal measurements are taken at a certain distance from the ends to differentiate the head area from the tail. The piercing area can now be calculated with this analysis.

Figure 2:
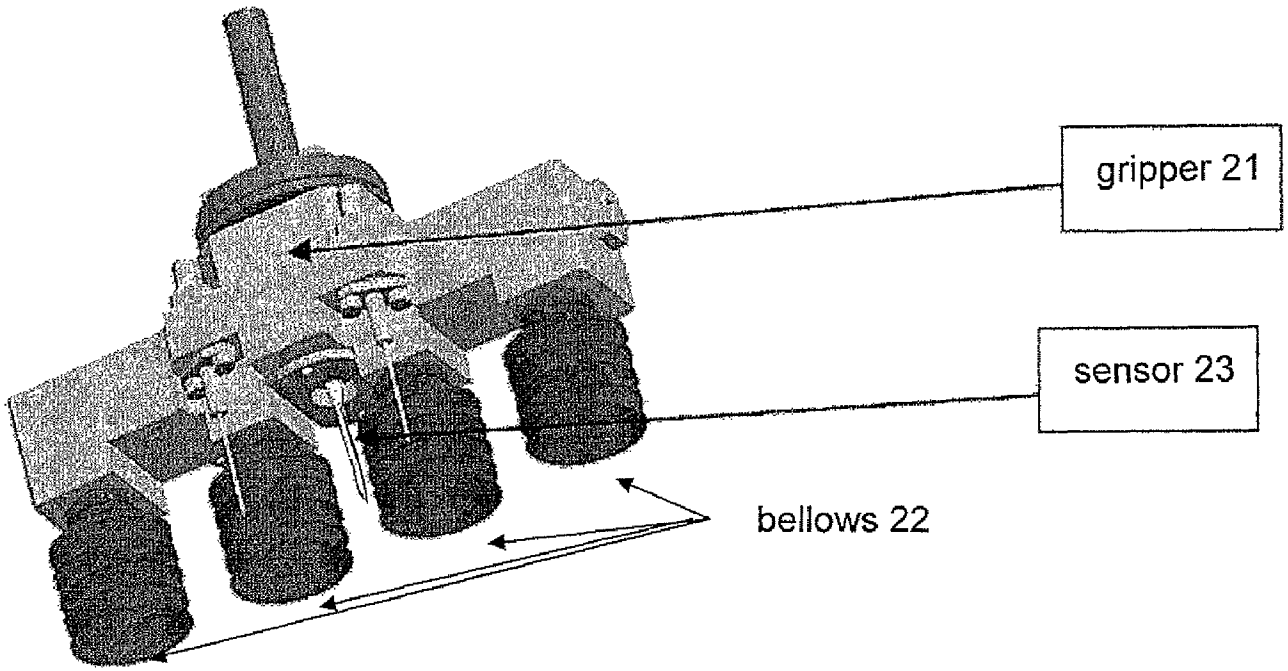
FIG. 2 illustrates the robot grip, bellows and sensor, according to embodiments of the present invention.

FIG. 2 illustrates the robot grip, bellows and sensor, according to embodiments of the present invention. The robotized manipulation grip 21 of the fish present in the robot operates via vacuum, in this example of embodiment.

The grip shows a vacuum suction system and a set of air outlets, at least one is necessary, to grip the fish. These are of bellows type 22 so that they easily adapt to the curvature of the different fish.

This system is complemented with at least one prod which permits avoiding the shear stresses on the air outlets, since as the fish and the water environment are very slipup, when the fish is moved laterally at high speed and subjected to high speed rotations and high acceleration, the inertias and the shear stresses are not withstood by the air outlets which mainly work by traction. It is necessary to insert the prods in the fish to avoid shear stresses.

To release or leave the fish quickly, not only does it break the vacuum in the system, but additionally blows air through the air outlets, which accelerates the process and also contributes to cleaning the internal areas of the air outlets.

Some of the prods, those positioned in the ventral area of the fish have the probe of the sensor which is introduced until the gonads in a protected manner.

The sensor 23 is inserted on the fish gonads and analyses the spectrum obtained after the impact of electromagnetic radiation on the gonad, the spectrums of the male and the female being different.

Once the decision is made on the gender of the fish, the robotized grip 21 deposits the fish on the correct conveyor belt.

Variations in materials, shape, size and arrangement of the component elements, described in non-limitative manner, do not alter the essential characteristics of this invention, it being sufficient to be reproduced by a person skilled in the art.

The invention claimed is:

1. An automatic method for classification and separation of foods, the method comprising the steps of:

feeding of the food to be classified into a conveyor belt along which the food moves;

determining using a localization system, the position, orientation, geometry and size of the food;

positioning a robotized grip on the food, according to the information obtained by said localization system;

inserting a sensor located on said robotized grip to said food;

collecting data using said sensor classifying the food according to the data obtained by said sensor; and separating the classified food.

2. The automatic method according to claim 1, wherein said step of separating said classified food is performed by said robotized grip.

3. The automatic method according to claim 1, wherein said food is fish.

4. The automatic method according to claim 1, wherein said step of collecting data using said sensor comprises further the step of analyzing data collected from said fish gonads in order to differentiate between male and female fish.

5. An automatic system for classification and separation of foods, the system comprises:

a conveyor belt along which the food moves;

a localization system configured to determine the position, orientation, geometry and size of the food;

a robotized grip which is positioned on the food, using the information obtained by said localization system;

at least one sensor located on the robotized grip configured to be inserted to the food and used to collect data of said food; and a computer for classifying data collected by said sensor.

6. The automatic system according to claim 5, wherein said localization system is a vision system.

7. The automatic system according to claim 5, wherein said robotized grip is further configured to separate the classified food.

8. The automatic system according to claim 5, wherein said classified food is male and female fish classified according to the reflection of their gonads captured by said sensor.

* * * * *